US009623546B2

(12) United States Patent
Keng

(10) Patent No.: US 9,623,546 B2
(45) Date of Patent: Apr. 18, 2017

(54) MULTIPURPOSE HAND HELD TOOLS

(71) Applicant: Shane Keng, Marietta, GA (US)

(72) Inventor: Shane Keng, Marietta, GA (US)

( * ) Notice: Subject to any disclaimer, the term of this patent is extended or adjusted under 35 U.S.C. 154(b) by 0 days.

(21) Appl. No.: 14/643,535

(22) Filed: Mar. 10, 2015

(65) Prior Publication Data

US 2015/0183105 A1 Jul. 2, 2015

Related U.S. Application Data

(63) Continuation of application No. 13/557,587, filed on Jul. 25, 2012, now abandoned.

(60) Provisional application No. 61/511,313, filed on Jul. 25, 2011, provisional application No. 61/548,482, filed on Oct. 18, 2011.

(51) Int. Cl.

| | |
|---|---|
| ***B25G 1/08*** | (2006.01) |
| ***B25F 1/00*** | (2006.01) |
| ***B25F 1/04*** | (2006.01) |
| *B26B 11/00* | (2006.01) |

(52) U.S. Cl.

CPC ..... *B25F 1/003* (2013.01); *B25F 1/04* (2013.01); *B25G 1/08* (2013.01); *B25G 1/085* (2013.01); *B26B 11/00* (2013.01); *B26B 11/001* (2013.01)

(58) Field of Classification Search

CPC ..... B26B 11/00; B26B 11/001; B26B 11/006; B25F 1/003; B25F 1/04

USPC ..... 7/118, 128

See application file for complete search history.

(56) References Cited

U.S. PATENT DOCUMENTS

| | | | | |
|---|---|---|---|---|
| 1,222,458 | A * | 4/1917 | Peterson | B62J 6/02 224/420 |
| 4,390,927 | A * | 6/1983 | Von Feldt | F21L 15/14 362/191 |
| 5,144,546 | A * | 9/1992 | Burdi | F21L 15/14 224/420 |
| 5,573,329 | A * | 11/1996 | van Gennep | B25B 7/22 248/229.13 |
| D406,508 | S * | 3/1999 | Rivera | D8/52 |
| 5,921,654 | A * | 7/1999 | Coyle | B25B 7/22 362/119 |
| 6,279,186 | B1 * | 8/2001 | Ge et al. | 7/163 |
| 6,908,216 | B2 * | 6/2005 | Love | A01K 75/02 362/191 |
| 7,008,077 | B2 * | 3/2006 | Raichlen | A47J 37/0786 294/16 |
| 7,278,764 | B2 * | 10/2007 | Kim | F21V 21/0885 362/103 |
| 8,087,115 | B2 * | 1/2012 | Barber et al. | 7/167 |
| 8,316,492 | B2 * | 11/2012 | Barber et al. | 7/118 |
| 2006/0164846 | A1 * | 7/2006 | Kim | B25G 3/18 362/382 |
| 2006/0262518 | A1 * | 11/2006 | Thuma | B25F 1/04 362/119 |
| 2009/0000038 | A1 * | 1/2009 | Padden | B25F 1/006 7/128 |

(Continued)

*Primary Examiner* — Monica Carter
*Assistant Examiner* — Danny Hong
(74) *Attorney, Agent, or Firm* — Eversheds Sutherland (US) LLP

(57) ABSTRACT

A multipurpose hand held tool includes a handle and one or more tools. The multipurpose tool further may include a multi-layered plier head. The multipurpose tool also may include a flashlight detachably coupled to the handle. In this manner, the multipurpose tool may incorporate multiple tools and accessories for completing various tasks.

8 Claims, 13 Drawing Sheets

(56) References Cited

U.S. PATENT DOCUMENTS

2013/0025071 A1* 1/2013 Keng ..... 7/118

* cited by examiner

MULTIPURPOSE HAND HELD TOOLS

CROSS-REFERENCE TO RELATED APPLICATIONS

The present application is a continuation of U.S. Non-provisional patent application Ser. No. 13/557,587, filed Jul. 25, 2012, which claims priority to and the benefit of U.S. Provisional Patent Application No. 61/511,313, filed on Jul. 25, 2011, and U.S. Provisional Patent Application No. 61/548,482, filed on Oct. 18, 2011, which are all hereby incorporated by reference in their entirety.

FIELD OF THE DISCLOSURE

The present application relates generally to hand held tools and more particularly to multipurpose hand held tools and accessories.

BACKGROUND

Traditional multipurpose hand held tools combine various hand tools, instruments, and accessories in a compact and portable unit. For example, a multipurpose tool may include a knife blade, a saw blade, a file, a screwdriver, a hook, tweezers, scissors, and other commonly used tools. Certain multipurpose tools may combine different component tools and accessories that are all useful for a specific task or activity, such as cleaning a firearm, working in a shop, or camping. Many multipurpose tools have a folding configuration that allows a component tool to be rotated from a storage position to a deployed position. Such multipurpose tools may also include a locking mechanism for holding the component tool in the storage position or the deployed position. Other multipurpose tools may include a retention or coupling mechanism for retaining a detachable tool or accessory.

As the tool needs and desires of consumers evolve, there is a continuing demand for an improved multipurpose tool that combines more component tools and accessories in a single unit without the overall tool becoming too bulky to carry or too cumbersome to operate. Additionally, with regards to folding multipurpose tools, there is a desire to provide an improved locking mechanism that allows a component tool to be locked at different positions relative to a frame or handle of a multipurpose tool. Furthermore, there is a desire to provide an improved retention or coupling mechanism for incorporating detachable tools and accessories into a multipurpose tool. Such improvements would enable a user to complete more tasks quickly and safely, while also enhancing overall ease of use of a multipurpose tool.

BRIEF DESCRIPTION OF THE DRAWINGS

The detailed description is set forth with reference to the accompanying drawings. The use of the same reference numerals indicates similar or identical items. Various embodiments may utilize elements and/or components other than those illustrated in the drawings and some elements and/or components may not be present in various embodiments. Throughout this disclosure, depending on the context, singular and plural terminology may be used interchangeably.

DETAILED DESCRIPTION OF THE DISCLOSURE

Figure 1:
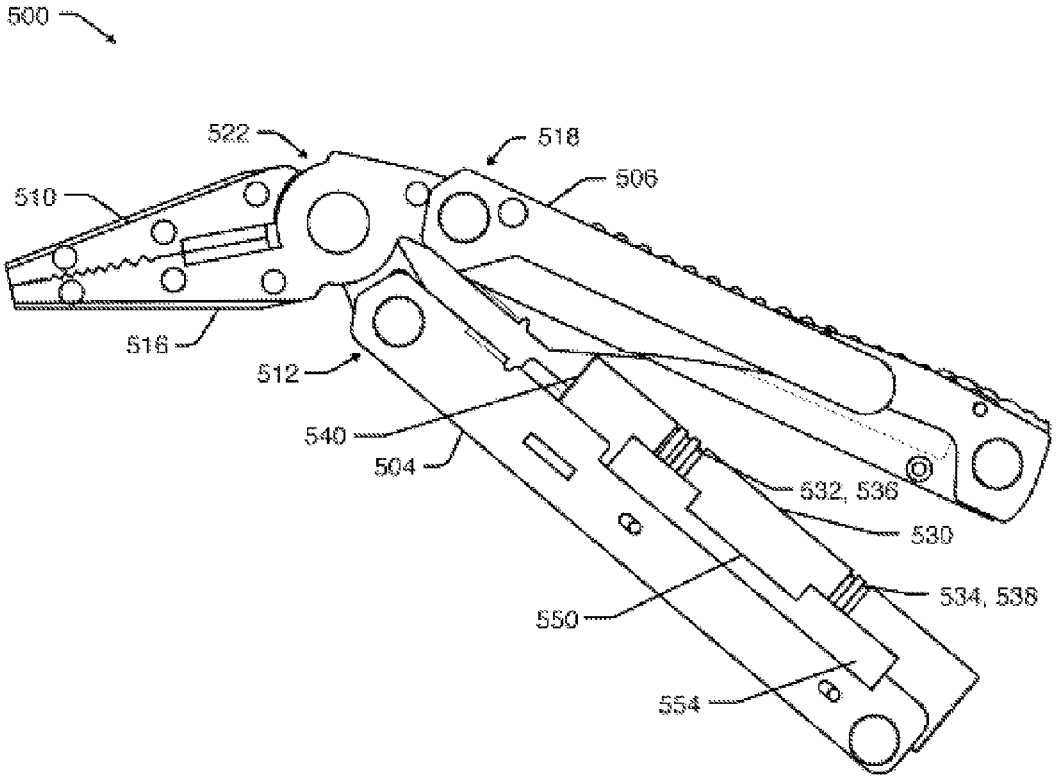
FIG. 1 depicts a front view of an example multipurpose hand held tool in accordance with one or more embodiments of the disclosure, wherein handles of the multipurpose tool are in an open position.

The present disclosure includes various examples of multipurpose hand held tools that address one or more of the above-mentioned areas of improvement. Specifically, one or more of the examples may include component tools or accessories that are not provided in existing multipurpose tools. Additionally, one or more of the examples may provide component tools or accessories in a novel configuration. Accordingly, the various examples disclosed may enable a user to complete more tasks quickly and safely, while also enhancing overall ease of use of the multipurpose tool.

For example, a multipurpose hand held tool is disclosed that may include a first handle, a second handle, a first multi-layered plier head, and a second multi-layered plier head. The first handle may be rotatably coupled to the first plier head at a first hinge, and the second handle may be rotatably coupled to the second plier head at a second hinge. The first plier head and the second plier head may be rotatably coupled at a third hinge. The first plier head may include a first layer having a plurality of teeth and a second layer having a cutting tool. The second plier head may include a first layer having a cutting tool and a second layer having a plurality of teeth. In this manner, the configuration of the multi-layered plier heads incorporate a plurality of teeth and a cutting tool without requiring overly complex machining of the plier heads.

In another example, a multipurpose hand held tool is disclosed that may include a first handle, a second handle, and a flashlight detachably coupled to the first handle. The first handle may be rotatably coupled to a first plier head at a first hinge, and the second handle may be rotatably coupled to a second plier head at a second hinge. The first plier head and the second plier head may be rotatably coupled at a third hinge. The multipurpose tool may further include a coupling mechanism for detachably coupling the flashlight to the first handle. In certain embodiments, the coupling mechanism may include a carrier, and a portion of the flashlight may be removably received within the carrier by a snap fit. The flashlight may include one or more grooves, and the carrier may include one or more ribs removably received within the one or more grooves of the flashlight. In this manner, the coupling mechanism may incorporate the flashlight into the multipurpose tool, while allowing for quick removal of the flashlight for subsequent use apart from the multipurpose tool. In certain embodiments, the flashlight may include an activation button, and the first handle may include an activation protrusion. The carrier may be slideably connected to the first handle such that the activation button of the flashlight may be slid into contact with the activation protrusion to activate or deactivate the flashlight. In this manner, the coupling mechanism may allow the flashlight to be used while connected to the multipurpose tool.

These and other examples will be described in more detail through reference to the accompanying drawings in the following description. It is understood, however, that the multipurpose hand held tools are not limited to the details of construction and the arrangements of the components set forth in the detailed description or shown in the accompanying drawings. The multipurpose tools are capable of other embodiments and being produced in various alternative ways. Other embodiments, aspects, and features of the multipurpose tools will become apparent to those skilled in the art from the detailed description, the accompanying drawings, and the appended claims.

Figure 2:
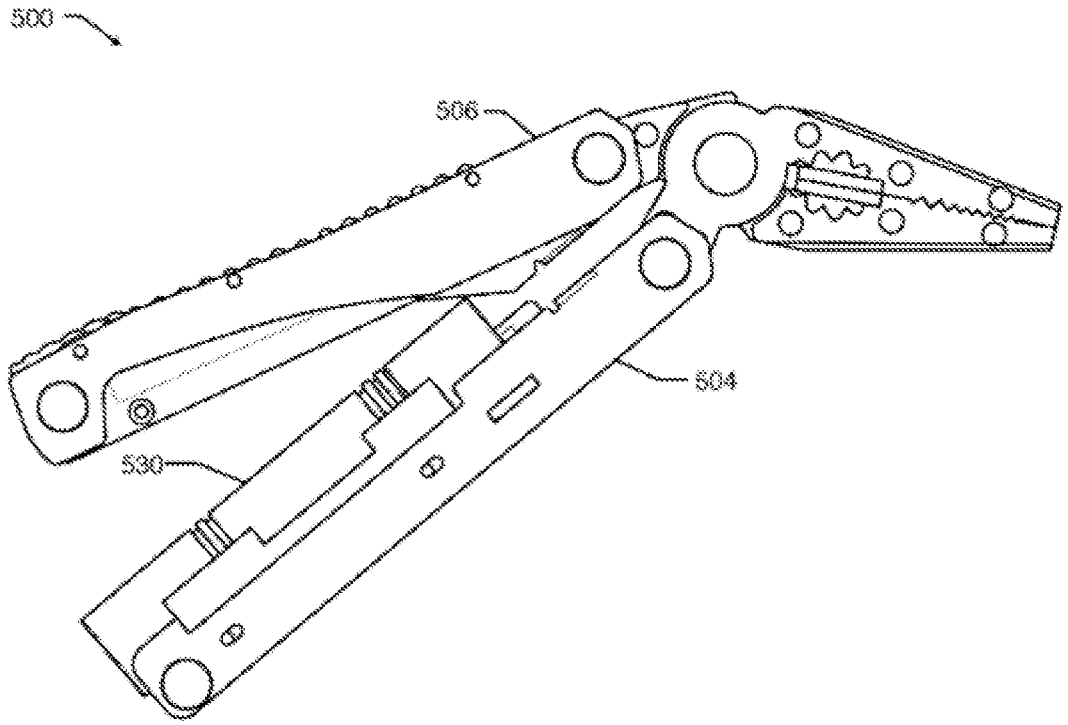
FIG. 2 depicts a back view of the example multipurpose hand held tool in accordance with one or more embodiments of the disclosure, wherein the handles are in the open position.
Figure 3:
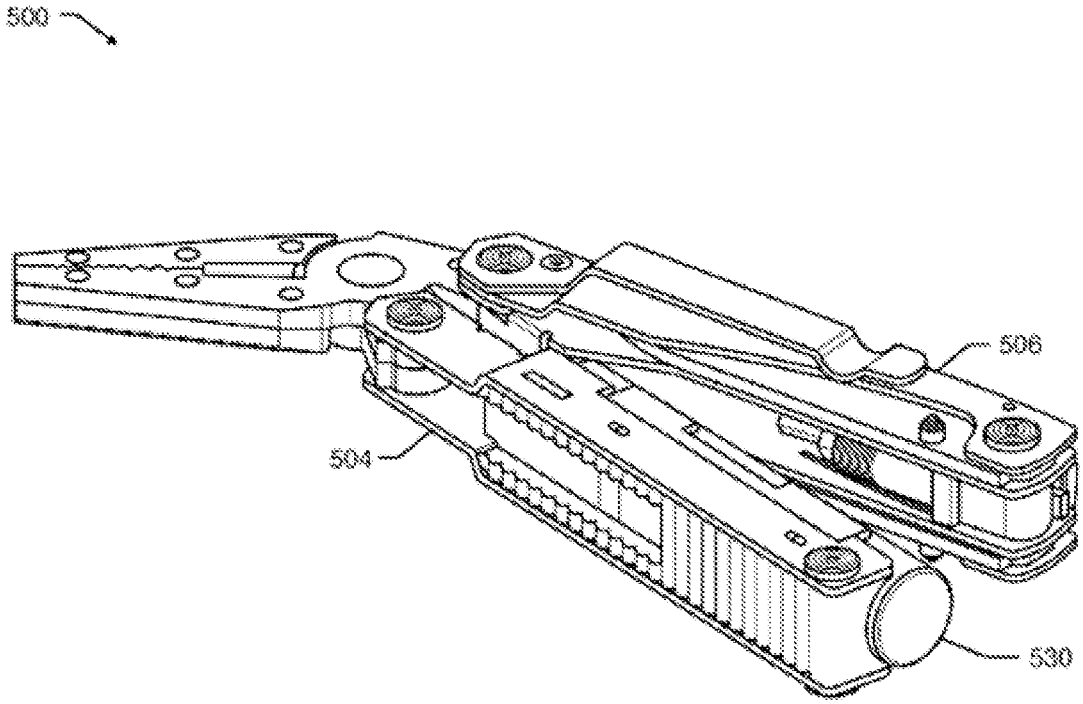
FIG. 3 depicts a perspective view of the example multipurpose hand held tool in accordance with one or more embodiments of the disclosure, wherein the handles are in the open position.
Figure 4:
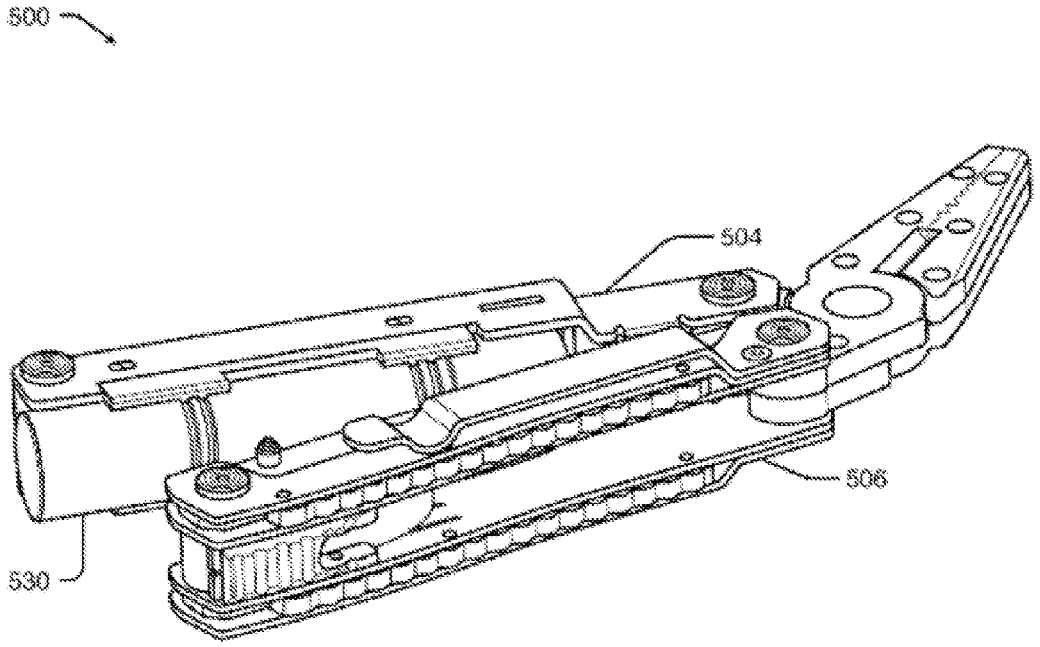
FIG. 4 depicts a perspective view of the example multipurpose hand held tool in accordance with one or more embodiments of the disclosure, wherein the handles are in the open position.
Figure 5:
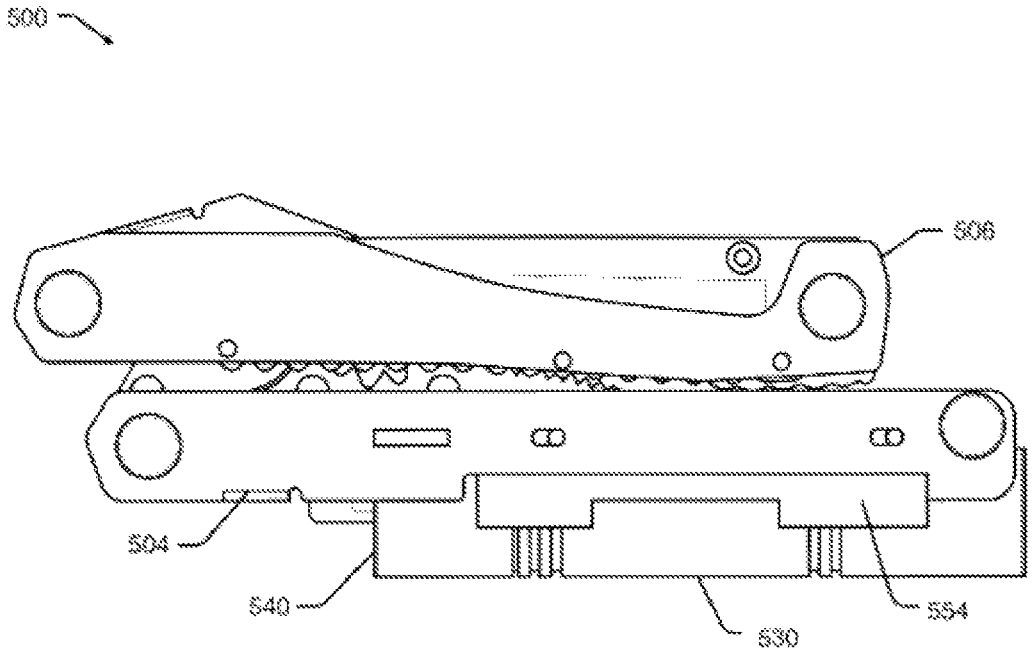
FIG. 5 depicts a back view of the example multipurpose hand held tool in accordance with one or more embodiments of the disclosure, wherein the handles are in a closed position.
Figure 6:
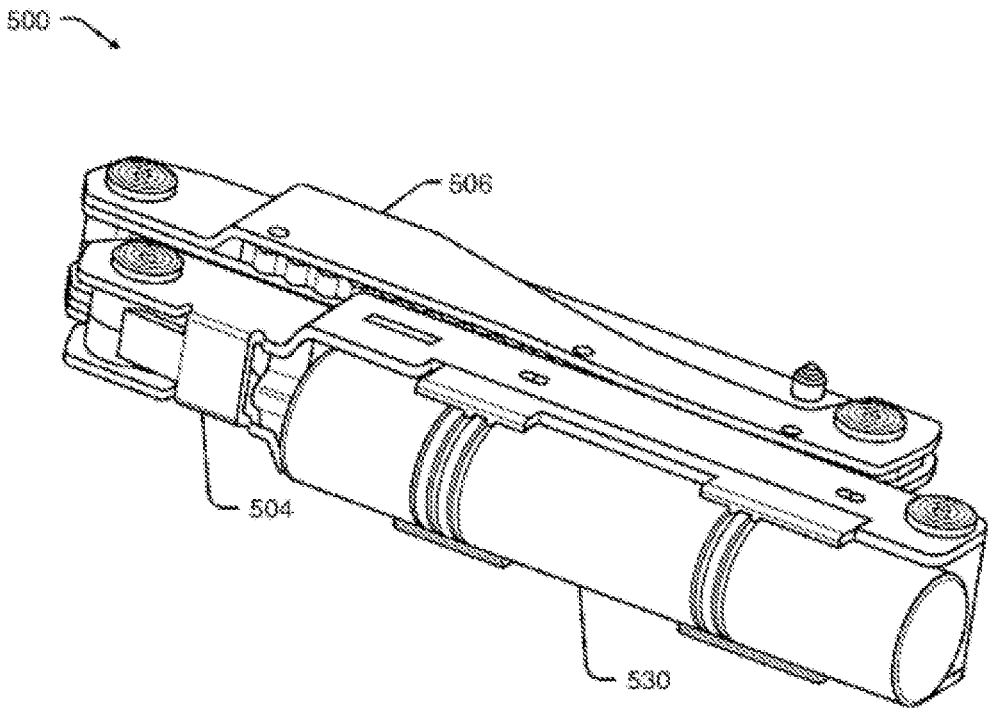
FIG. 6 depicts a perspective view of the example multipurpose hand held tool in accordance with one or more embodiments of the disclosure, wherein the handles are in the closed position.
Figure 7:
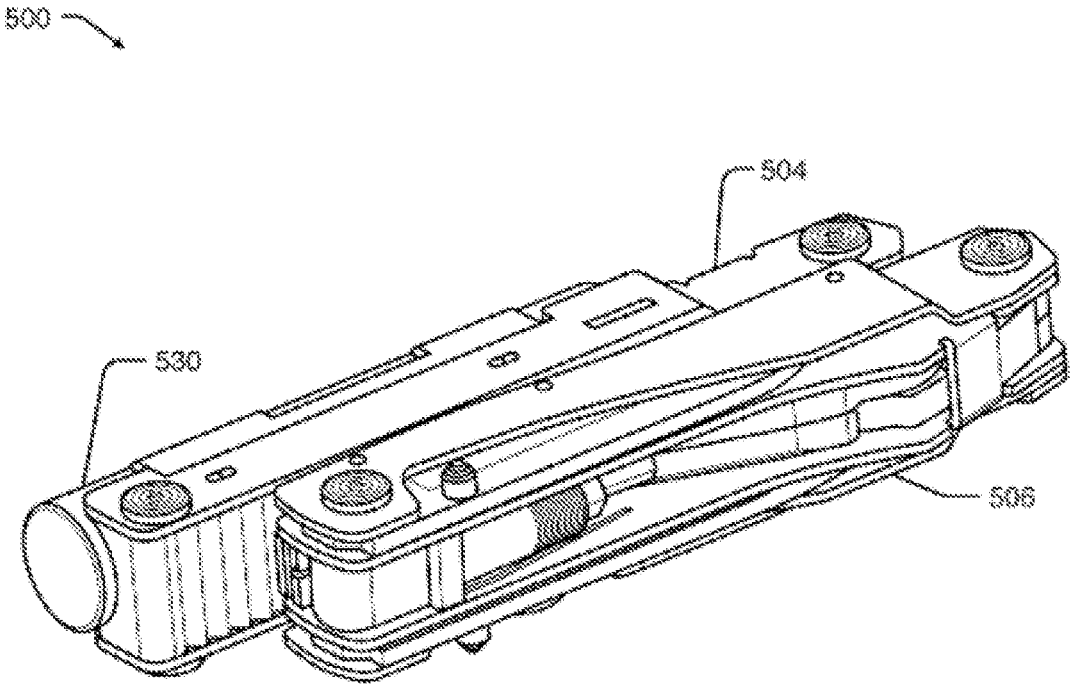
FIG. 7 depicts a perspective view of the example multipurpose hand held tool in accordance with one or more embodiments of the disclosure, wherein the handles are in the closed position.
Figure 8:
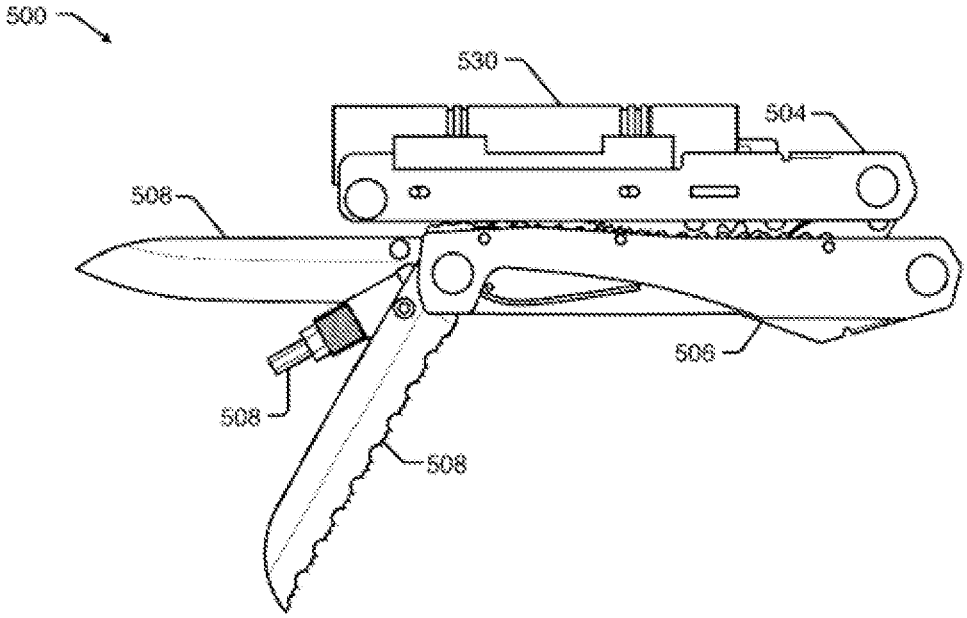
FIG. 8 depicts a front view of the example multipurpose hand held tool in accordance with one or more embodiments of the disclosure, wherein the handles are in the closed position and component tools are in a deployed position.
Figure 9:
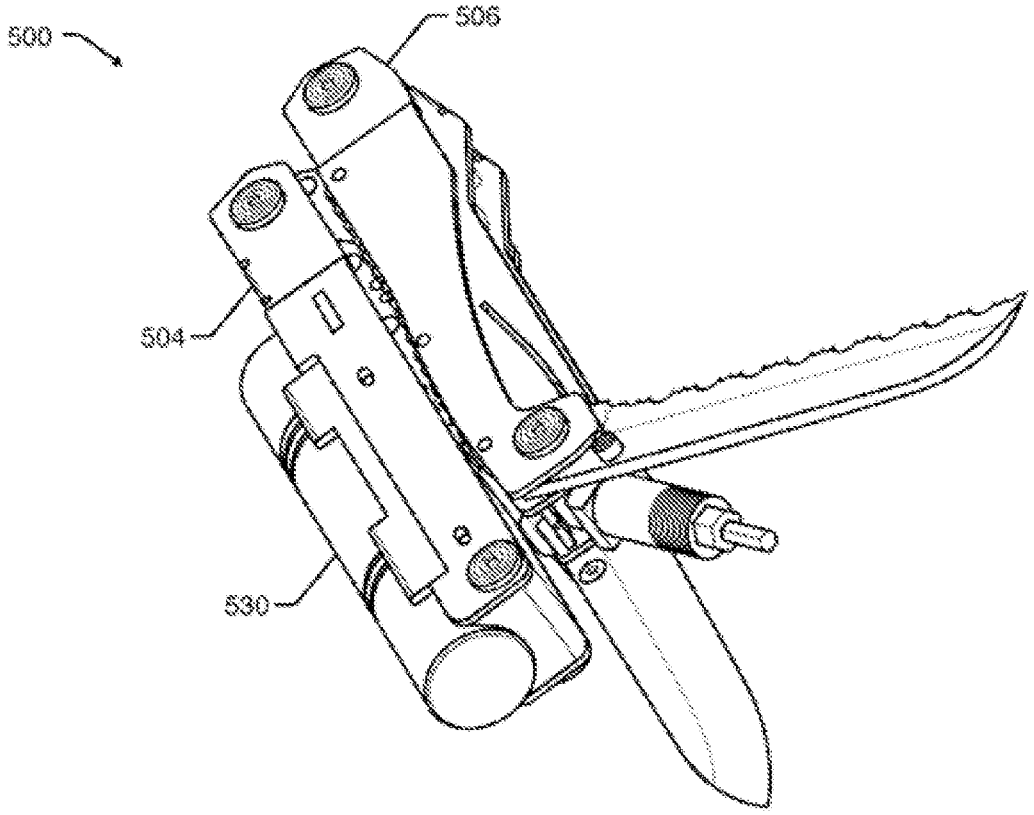
FIG. 9 depicts a perspective view of the example multipurpose hand held tool in accordance with one or more embodiments of the disclosure, wherein the handles are in the closed position and the component tools are in a deployed position.
Figure 10:
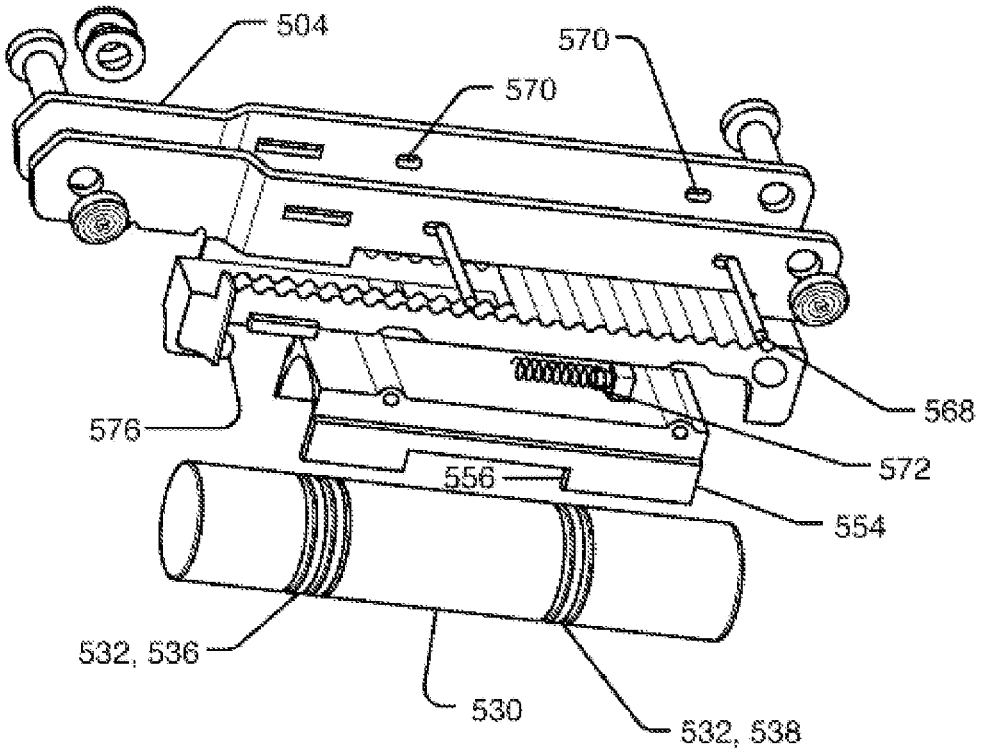
FIG. 10 depicts an exploded perspective view of a handle, a coupling mechanism, and a detachable accessory of the example multipurpose hand held tool in accordance with one or more embodiments of the disclosure.
Figure 11:
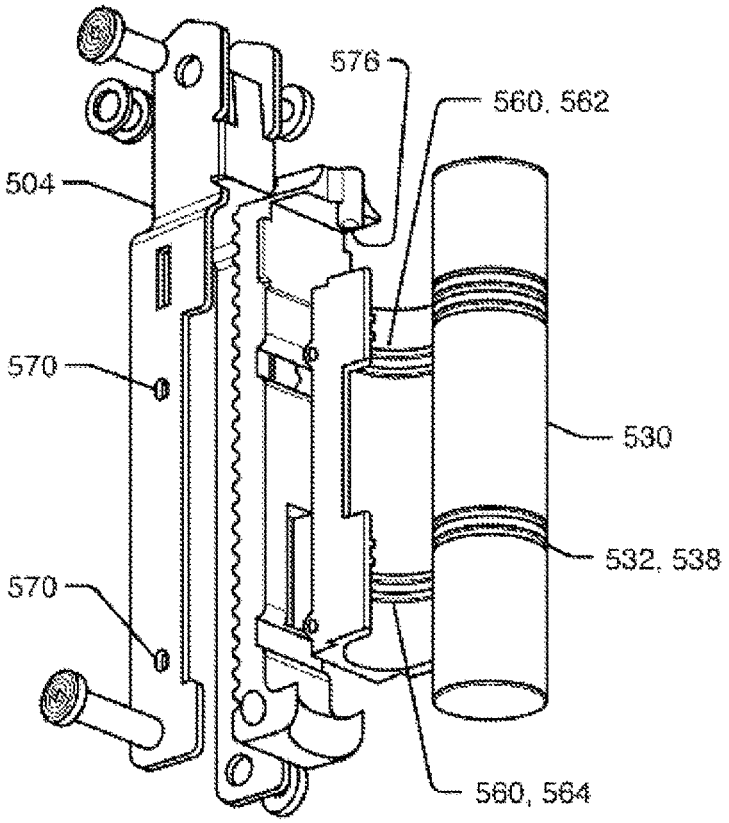
FIG. 11 depicts an exploded perspective view of the handle, the coupling mechanism, and the detachable accessory of the example multipurpose hand held tool in accordance with one or more embodiments of the disclosure.
Figure 12:
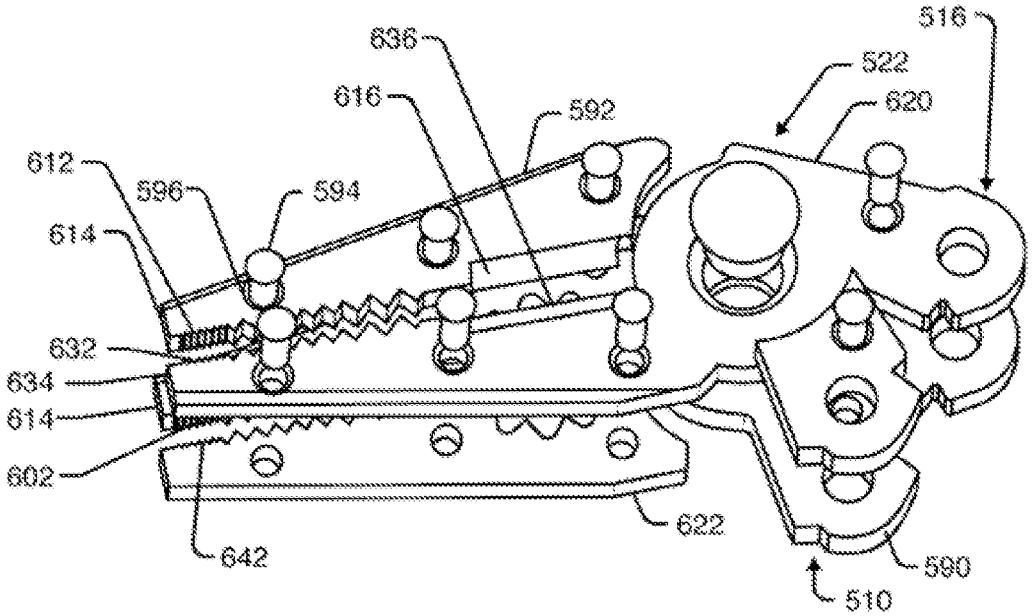
FIG. 12 depicts an exploded perspective view of a plier head assembly of the example multipurpose hand held tool in accordance with one or more embodiments of the disclosure.
Figure 13:
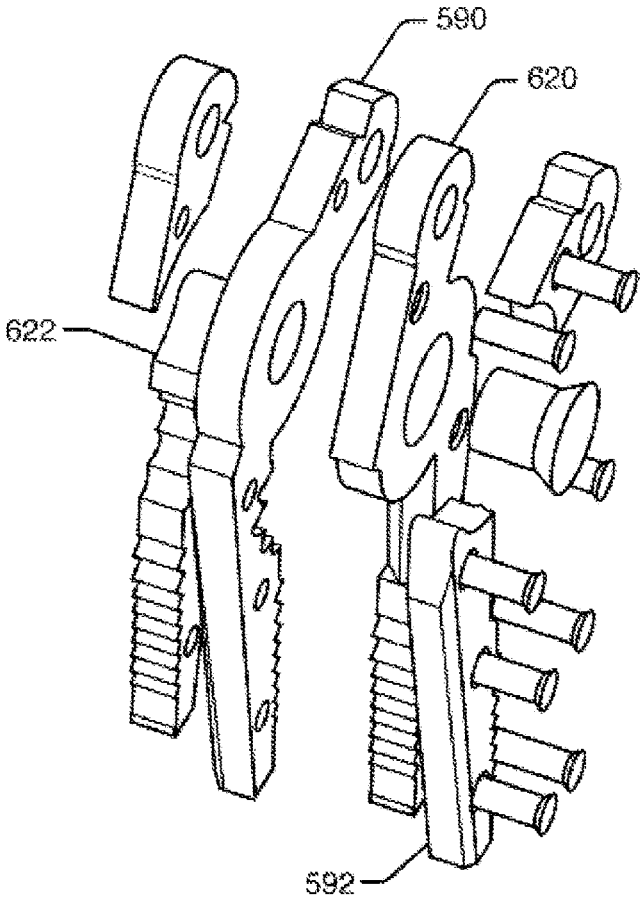
FIG. 13 depicts an exploded perspective view of the plier head assembly of the example multipurpose hand held tool in accordance with one or more embodiments of the disclosure.

FIGS. 1-13 depict various views of a multipurpose hand held tool 500 in accordance with an embodiment of the disclosure. Specifically, FIG. 1 depicts a front view of the multipurpose tool 500 with handles in an open position, FIG. 2 depicts a back view of the multipurpose tool 500 with the handles in the open position, FIG. 3 depicts a perspective view of the multipurpose tool 500 with the handles in the open position, FIG. 4 depicts a perspective view of the multipurpose tool 500 with the handles in the open position, FIG. 5 depicts a back view of the multipurpose tool 500 with the handles in a closed position, FIG. 6 depicts a perspective view of the multipurpose tool 500 with the handles in the closed position, FIG. 7 depicts a perspective view of the multipurpose tool 500 with the handles in the closed position, FIG. 8 depicts a front view of the multipurpose tool 500 with the handles in the closed position and component tools in a deployed position, FIG. 9 depicts a perspective view of the multipurpose tool 500 with the handles in the closed position and component tools in a deployed position, FIG. 10 depicts an exploded perspective view of a handle, a coupling mechanism, and a detachable accessory of the multipurpose tool 500, FIG. 11 depicts an exploded perspective view of the handle, the coupling mechanism, and the detachable accessory of the multipurpose tool 500, FIG. 12 depicts an exploded perspective view of a plier head assembly of the multipurpose tool 500, and FIG. 13 depicts an exploded perspective view of the plier head assembly of the multipurpose tool 500.

Collectively referring to FIGS. 1-13, and by way of example, the multipurpose tool 500 may include a first handle 504 and a second handle 506. The multipurpose tool 500 may also include component tools 508 connected to the first handle 504 or the second handle 506. In some examples, the component tools 508 may be rotatably connected to the first handle 504 or the second handle 506 by fasteners. Accordingly, the component tools 508 may be rotated from a storage position, as shown in FIG. 5, to one or more deployed positions, as shown in FIG. 8.

In some examples, the first handle 504 may be rotatably coupled to a first plier head 510 at a first hinge 512, and the second handle 506 may be rotatably coupled to a second plier head 516 at a second hinge 518. Additionally, the first plier head 510 and the second plier head 516 may be rotatably coupled at a third hinge 522. In this manner, the first plier head 510 and the second plier head 516 may rotate relative to one another about the third hinge 522 to provide traditional pliers action. Furthermore, the first handle 504 and the second handle 506 may be rotated relative to the first plier head 510 and the second plier head 516, respectively, about the first hinge 512 and the second hinge 518, respectively. In this manner, the handles 504, 506 may be rotated relative to the plier heads 510, 516 such that the plier heads 510, 516 may be in a deployed position, as shown in FIG. 1, or a storage position, as shown in FIG. 5.

In certain aspects, the first plier head 510 and the second plier head 516 may have an angled configuration relative to the handles 504, 506. In other words, when the handles 504, 506 are in the open position such that the plier heads 510, 516 are deployed for use, the handles 504, 506 are asymmetrically positioned with respect to the plier heads 510, 516. In some aspects, a length of the first handle 504 may be greater than a length of the second handle 506 in order to better accommodate the angled configuration of the plier heads 510, 516. In this manner, the angled configuration may provide improved visibility of an object being grasped due to the asymmetric position of the handles 504, 506 with respect to the plier heads 510, 516.

In certain examples, the multipurpose tool 500 may include a flashlight 530 detachably coupled to the first handle 504. The flashlight 530 may be cylindrical in shape. Alternatively, the flashlight 530 may assume other shapes that provide a regular or irregular cross-section. In some aspects, the flashlight 530 may include one or more grooves 532 for coupling the flashlight 530 to the first handle 504. The flashlight 530 may include a plurality of grooves 532 arranged parallel to one another along the flashlight 530. The plurality of grooves 532 may be spaced along an axis of the flashlight 530, and each groove 532 may extend circumferentially around an outer surface of the flashlight 530. In some aspects, the flashlight 530 may include a first plurality of grooves 536 axially spaced apart from a second plurality of grooves 538. The flashlight 530 also may include an activation button 540 that may be activated by contact such that the flashlight 530 provides light or stops providing light.

In certain aspects, the activation button 540 may be located at one end of the flashlight 530. Alternatively, the activation button 540 may be located on a side of the flashlight 530 or elsewhere on the outer surface of the flashlight 530. In some aspects, the activation button 540 may be accessible when the flashlight 530 is attached to the multipurpose tool 500. Specifically, the activation button 540 may be accessible when the first handle 504 is in the open position and also when the first handle 504 is in the closed position.

In some aspects, the flashlight 530 may be detachably coupled to the first handle 504 by a coupling mechanism 550. The coupling mechanism 550 may include a carrier 554, and a portion of the flashlight 530 may be removably received within the carrier 554. In certain aspects, the portion of the flashlight 530 may be removably received within the carrier 554 by a snap fit or an interference fit. Accordingly, the carrier 554 may have a cupped shape that is sized slightly smaller than the flashlight 530 such that the carrier 554 may retain the flashlight 530. The carrier 554 may extend around at least half of a circumference of the flashlight 530 to ensure that the flashlight 530 is sufficiently retained. In some aspects, the carrier 554 may include a cutout 556 exposing more than half of the circumference of the flashlight 530 for ease of grasping the flashlight 530 for removal from the carrier 554. In certain aspects, the carrier 554 may include one or more ribs 560 on an inner surface of the carrier. The one or more ribs 560 may be removably received within the one or more grooves 532 of the flashlight 530 to prevent the flashlight 530 from moving axially within the carrier 554. The carrier 554 may include a plurality of ribs 560 arranged parallel to one another along the carrier 554. The plurality of ribs 560 may be spaced along an axis of the carrier 554, and each rib 560 may extend circumferentially around an outer surface of the flashlight 530. In some aspects, the carrier 554 may include a first plurality of ribs 562 axially spaced apart from a second plurality of ribs 564. In this manner, the coupling mechanism 550 may incorporate the flashlight into the multipurpose tool 500, while allowing for quick removal of the flashlight 530 for subsequent use apart from the multipurpose tool 500.

In certain aspects, the carrier 554 may be slideably connected to the first handle 504 such that the carrier 554 may be able to slide from a first position to a second position along a length of the first handle 504. Accordingly, when the flashlight 530 is received within the carrier 554, the flashlight 530 may be able to slide along the length of the first handle 504. In some aspects, the carrier 554 may be slideably connected to the first handle 504 by one or more pins 568 slideably received within one or more slots 570 defined in the first handle 504. Accordingly, the first position and the second position of the carrier 554 relative to the first handle 504 may be defined by the location and size of the slots 570. In certain aspects, the coupling mechanism 550 may further include a spring 572 biasing the carrier 554 toward the first position. The spring 572 may be a compression spring contacting the carrier 554 and the first handle 504 such that the carrier 554 is biased toward the first position. Accordingly, the carrier 554 remains in the first position unless force is applied to the carrier 554 or flashlight 530 to overcome the resistance of the spring 572 and move the carrier 554 to the second position. In some aspects, the first handle 504 may include an activation protrusion 576 that contacts the activation button 540 of the flashlight 530 when the carrier 554 is in the second position. Such contact may activate the activation button 540 such that the flashlight 530 provides light or stops providing light. In this manner, the coupling mechanism 550 may incorporate the flashlight into the multipurpose tool 500, while allowing for quick activation or deactivation of the flashlight 530 when the flashlight is coupled to the first handle 504. Furthermore, the coupling mechanism may allow the flashlight 530 to be activated or deactivated when the first handle 504 is in the open position or the closed position.

In certain examples, as shown in FIGS. 12 and 13, each of the first plier head 510 and the second plier head 516 may have a multi-layered configuration. The first plier head 510 may include a first layer 590 and a second layer 592. The first layer 590 and the second layer 592 of the first plier head 510 may be connected by fasteners 594. The fasteners 594 may be received within corresponding holes 596 defined in each of the first layer 590 and the second layer 592. In certain aspects, the fasteners 594 may be press-fit pins, rivets, or other known fasteners. The first layer 590 may include a plurality of teeth 602 positioned between the third hinge 522 and a distal tip 604 of the first layer 590. The second layer 592 may include a plurality of teeth 612 positioned between the third hinge 522 and a distal tip 614 of the second layer 592. The second layer 592 also may include a cutting tool 616 positioned between the third hinge 522 and the plurality of teeth 612 of the second layer 592. In this manner, the plurality of teeth 612 of the first layer 590 may extend over the cutting tool 616 of the second layer 592 of the first plier head 510. The second plier head 516 similarly may include a first layer 620 and a second layer 622. The first layer 620 and the second layer 622 of the second plier head 516 may be connected by fasteners 594. The fasteners 594 may be received within corresponding holes 596 defined in each of the first layer 620 and the second layer 622. The first layer 620 may include a plurality of teeth 632 positioned between the third hinge 522 and a distal tip 634 of the first layer 590. The first layer 620 also may include a cutting tool 636 positioned between the third hinge 522 and the plurality of teeth 632 of the first layer 620. The second layer 622 may include a plurality of teeth 642 positioned between the third hinge 522 and a distal tip 644 of the second layer 622. In this manner, the plurality of teeth 642 of the second layer 622 may extend over the cutting tool 636 of the first layer 620 of the second plier head 516. Accordingly, each of the first plier head 510 and the second plier head 516 may incorporate a plurality of teeth and a cutting tool without requiring overly complex machining of the plier heads.

In some aspects, one or more of the plurality of teeth 602, 612, 632, 642 may have a graduated configuration. In other words, the teeth 602, 612, 632, 642 may be smaller towards the distal tip 604, 614, 634, 644, respectively, and gradually increase in size towards the third hinge 522. In other aspects, one or more of the plurality of teeth 602, 612, 632, 644 may vary in size according to a stepped configuration. That is, the teeth 602, 612, 632, 642 may include groupings of teeth that are the same size, and the size of the teeth in each grouping may increase from the distal tip 604, 614, 634, 644 towards the third hinge 522. In is understood that the graduated configuration or stepped configuration of the teeth may be incorporated into one or both of the first plier head 510 and the second plier head 516 whether the plier heads 510, 516 have a multi-layered configuration or a single layer configuration. By providing the teeth 602, 612, 632, 642 in a graduated configuration or stepped configuration, the plier heads 510, 516 may be able to grasp objects of many different sizes and shapes.

Although specific embodiments of the disclosure have been described, one of ordinary skill in the art will recognize that numerous other modifications and alternative embodiments are within the scope of the disclosure. Further, while embodiments of the disclosure have been described with respect to specific examples of multipurpose tool configurations, it will be appreciated that numerous other multipurpose tool configurations are within the scope of this disclosure. Still further, while embodiments of the disclosure have been described with respect to specific types of multipurpose tools, one should appreciate that numerous other types of multipurpose tools are within the scope of this disclosure.

Although embodiments have been described in language specific to structural features, it is to be understood that the disclosure is not necessarily limited to the specific features described. Rather, the specific features are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments do not include, certain features and/or elements. Thus, such conditional language is not generally intended to imply that features and/or elements are in any way required for one or more embodiments.

That which is claimed is:

1. A multipurpose hand held tool, comprising:

a first handle rotatably coupled to a first plier head at a first hinge;

a second handle rotatably coupled to a second plier head at a second hinge, wherein the first plier head and the second plier head are rotatably coupled at a third hinge;

a flashlight;

a coupling mechanism configured to detachably couple the flashlight to the first handle, wherein the coupling mechanism comprises a cupped shaped carrier connected to the first handle, wherein a portion of the flashlight is removably received within the cupped shaped carrier by a snap fit, wherein the cupped shaped carrier is slideably connected to the first handle such that the carrier is configured to slide from a first position to a second position along a length of the first handle, wherein the coupling mechanism further comprises a spring biasing the cupped shaped carrier toward the first position, wherein the flashlight comprises an activation button, wherein the first handle comprises an activation protrusion, and wherein the activation protrusion of the first handle contacts the activation button of the flashlight when the cupped shaped carrier is in the second position to activate or deactivate the flashlight.

2. The multipurpose hand held tool of claim 1, wherein the flashlight comprises one or more grooves, wherein the cupped shaped carrier comprises one or more ribs, and wherein the one or more ribs of the cupped shaped carrier are removably received within the one or more grooves of the flashlight.

3. The multipurpose hand held tool of claim 1, wherein the cupped shaped carrier is slideably connected to the first handle by one or more pins slideably received within one or more slots defined in the first handle.

4. The multipurpose hand held tool of claim 2, wherein the one or more grooves comprise a first plurality of grooves axially spaced apart from a second plurality of grooves, wherein the one or more ribs comprise a first plurality of ribs axially spaced apart from a second plurality of ribs.

5. The multipurpose hand held tool of claim 4, wherein the cupped shaped carrier comprises a cutout disposed between the first plurality of ribs and the second plurality of ribs.

6. The multipurpose hand held tool of claim 1, wherein the cupped shaped carrier comprises a cutout.

7. A multipurpose hand held tool, comprising:

a first handle rotatably coupled to a first plier head at a first hinge;

a second handle rotatably coupled to a second plier head at a second hinge, wherein the first plier head and the second plier head are rotatably coupled at a third hinge;

a flashlight;

a coupling mechanism configured to detachably couple the flashlight to the first handle, wherein the coupling mechanism comprises a carrier slidably connected to the first handle by one or more pins slideably received within one or more slots defined in the first handle such that the carrier slides from a first position to a second position along a length of the first handle, wherein the one or more pins and the one or more slots are transverse to the length of the first handle, wherein the carrier is configured to snap fit at least a portion of the flashlight thereto, and wherein the carrier comprises at least one rib configured to mate with the at least one groove of the flashlight, wherein the cupped shaped carrier is slideably connected to the first handle such that the carrier is configured to slide from a first position to a second position along a length of the first handle, wherein the coupling mechanism further comprises a spring biasing the cupped shaped carrier toward the first position, wherein the flashlight comprises an activation button, wherein the first handle comprises an activation protrusion, and wherein the activation protrusion of the first handle contacts the activation button of the flashlight when the cupped shaped carrier is in the second position to activate or deactivate the flashlight.

8. A multipurpose hand held tool, comprising:

a first handle rotatably coupled to a first plier head at a first hinge;

a second handle rotatably coupled to a second plier head at a second hinge, wherein the first plier head and the second plier head are rotatably coupled at a third hinge;

a flashlight comprising an activation bottom and at least one groove; and a coupling mechanism configured to detachably couple the flashlight to the first handle, wherein the coupling mechanism comprises:

a carrier slidably connected to the first handle by one or more pins slideably received within one or more slots defined in the first handle such that the carrier slides from a first position to a second position along a length of the first handle, wherein the one or more pins and the one or more slots are transverse to the length of the first handle, wherein the carrier is configured to snap fit at least a portion of the flashlight thereto, and wherein the carrier comprises at least one rib configured to mate with the at least one groove of the flashlight, a spring disposed between the carrier and the first handle and biasing the carrier toward the first position, wherein the carrier remains in the first position unless a force is applied to the carrier or flashlight to overcome the spring and move the carrier to the second position, and an activation protrusion disposed on the first handle that contacts the activation button of the flashlight when the carrier is in the second position to activate or deactivate the flashlight.

* * * * *